United States Patent [19]

Reiner

[11] Patent Number: 4,871,778

[45] Date of Patent: Oct. 3, 1989

[54] PROCESS FOR THE PRODUCTION OF A PERMSELECTIVE AND FLEXIBLE ANION EXCHANGE MEMBRANE

[75] Inventor: Andreas Reiner, Merzhausen, Fed. Rep. of Germany

[73] Assignee: Frauhofer-Gesellschaft zur Foderung der angewandten Forschung e.V., Munich, Fed. Rep. of Germany

[21] Appl. No.: 80,174

[22] Filed: Jul. 30, 1987

Related U.S. Application Data

[63] Continuation of Ser. No. 808,159, Dec. 12, 1985, abandoned.

[30] Foreign Application Priority Data

Dec. 27, 1984 [DE] Fed. Rep. of Germany ..... 3447483

[51] Int. Cl.[4] ..... C08D 5/20

[52] U.S. Cl. ..... 521/27; 521/31

[58] Field of Search ..... 521/27, 31

[56] References Cited

U.S. PATENT DOCUMENTS

| | | | |
|---|---|---|---|
| 2,828,270 | 3/1958 | Murato | 525/327.1 |
| 2,899,386 | 8/1959 | Adams et al. | 521/31 |
| 3,752,794 | 8/1973 | Beskai | 526/265 |
| 4,116,889 | 9/1978 | Chlovda et al. | 521/27 |
| 4,322,501 | 3/1982 | Lee et al. | 521/27 |

FOREIGN PATENT DOCUMENTS 3319798 3/1984 Fed. Rep. of Germany .

*Primary Examiner*—Joseph L. Schofer
*Assistant Examiner*—Peter F. Kulkosky
*Attorney, Agent, or Firm*—Walter N. Schneider

[57] ABSTRACT

The invention relates to a process for the production of a permselective and flexible anion exchange membrane by application of a solution of a polymer containing polyvinylpyridine and/or a derivative thereof as anion exchanger to a carrier material and evaporation of the solvent. According to the invention, a solution of a copolymer of vinylpyridine and/or a derivative thereof and of a monomer, which does not form fixed ions either during the cross-linking reaction or in the electrolyte, or of a mixture of such monomers is applied to the carrier material, the film is subjected while moist to quaternization and the membrane formed is optionally removed from the carrier material. In preferred embodiments of the invention, the solution of the copolymer of vinylpyridine and the monomer additionally contains polyvinylbenzyl halide or a copolymer of vinylbenzyl halide and a monomer.

6 Claims, No Drawings

PROCESS FOR THE PRODUCTION OF A PERMSELECTIVE AND FLEXIBLE ANION EXCHANGE MEMBRANE

This is a continuation of Application Ser. No. 808,159 fled Dec. 12, 1985, now abandoned.

This invention relates to a process for the production of a permselective and flexible anion exchanger membrane.

DE 3 319 798 Cl describes a process for the production of a permselective anion exchanger membrane. This known process uses only polymers for producing the membrane. This eliminates the difficulties involved in the handling of monomers and provides for very simple production. In this known process, the vinylpyridine nitrogen is quaternized with the halogen methyl group of the vinylbenzyl chloride. A macromolecular network is formed. For a stoichiometric ratio of vinylpyridine nitrogen to vinylbenzyl chloride (N:X) of 1:1, the network formed contains immediately adjacent fixed nitronium cations. The network is characterized by very small voids between the network arcs and hence by very high permselectivity for anions (cf. formula XI):

(XI)

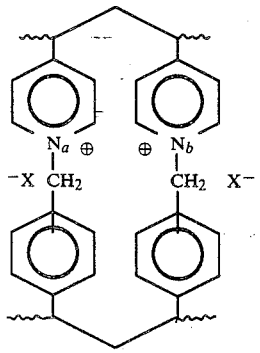

However, the high permselectivity for anions of the structure shown above is of no value in macroscopic terms because the films drawn with N:X=1:1 are extremely fragile. Even light mechanical stressing, such as inevitably occurs during installation of the membrane in the galvanic cell and during operation of the cell as a result of small variations in pressure, is sufficient to rupture the membrane. The reason for the fragility of the membrane is the strong fixed cation repulsion of the immediately adjacent fixed nitronium ions of which the possibilities of avoiding one another are seriously limited by attachment to the polymer chain and by the quaternization reaction.

The synthesis of membranes with N:X>1 gives structures of the type shown in formula XII below:

(XII)

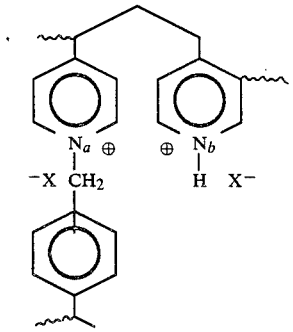

The non-quaternized N-atoms become fixed nitronium cations in the hydrochloric acid electrolyte.

Membranes with N:X>1 are less fragile than membranes with N:X=1:1. This lower fragility is attributable to the weaker fixed cation repulsion between the nitronium cations $N_a^+$ and $N_b^+$ in the structure shown in formula XII.

$N_b^+$ is not quarternized with the vinylbenzyl halide and, accordingly, has slightly greater possibilities of avoiding $N_a^+$ than $N_b^+$ in the structure shown in formula XI. However, N:X>1 also means larger voids between the network arcs and, hence, a reduction in the permeselectivity for anions without the membrane being sufficiently flexible. Experiments have shown that adequate flexibility of the membrane is only reached at N:X -values of around 10:1. With N:X values as high as these, the voids between the network arcs are so large that the permeselectivity for anions tends towards zero. Numerous experiments have shown that there is no N:X-ratio which, with the process described in DE 3 319 798 Cl, gives membranes which show sufficient permselectivity for anions and adequate flexibility.

The process described in DE 3 319 798 Cl only gives membranes which are either flexible, but unselective or which are selective, but extremely fragile. On the other hand, DE 3 319 798 Cl describes a process for the production of anion exchanger membranes which is unique in its simple practicability.

The object of the present invention is to provide a simple process for the production of anion exchanger membranes by which it is possible to obtain membranes showing high anion selectivity and adequate flexibility.

Accordingly, the present invention relates to a process for the reduction of a permselective and flexible anion exchanger membrane by application of a solution of a polymer containing polyvinyl pyridine and/or a derivative thereof as anion exchanger to a carrier material and evaporation of the solvent, characterized in that a solution of a copolymer of vinylpyridine and/or a derivative thereof and of a monomer, which does not form fixed ions either during the crosslinking reaction or in the electrolyte, or of a mixture of such monomers is applied to the carrier material, the film is subjected while moist to quaternization and the membrane formed is optionally removed from the carrier material.

In one preferred embodiment, the solution of the copolymer additionally contains a polyvinylbenzyl halide or a mixture of polyvinylbenzyl haides. In a second preferred embodiment of the process according to the invention, the solution of the copolymer additionally contains a second copolymer of vinylbenzyl halide and of a monomer, which does not form fixed ions either during the crosslinking reaction or in the electrolyte, or of a mixture of such monomers, the monomer being the same as or different from the monomer present in the first copolymer.

It has surprisingly been found that permselective and flexible anion exchanger membranes may readily be produced by the process according to the invention. According to the invention, a copolymer of, for example, 4-vinylpyridine (4VP) and styrene (S) prepared, for example, by radical copolymerization is used instead of the polyvinylpyridine used in the known process described in DE 3 319 798 Cl.

The 4VP-S copolymer contains vinylpyridine and styrene in a statistical sequence. Quaternization of the copolymer with the polyvinylbenzyl halide at room temperature produces a macromolecular network which, even with N:X=1:1, gives highly selective and sufficiently flexible anion exchanger membranes. Flexibility is achieved by the spatial separation of the quaternized nitronium cations by styrene, as shown in the following formula:

(XIIIa)

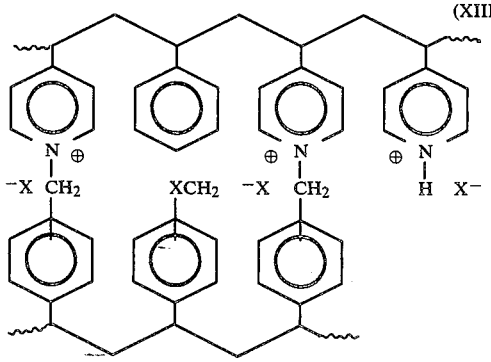

N: X = 1

(XIIIb)

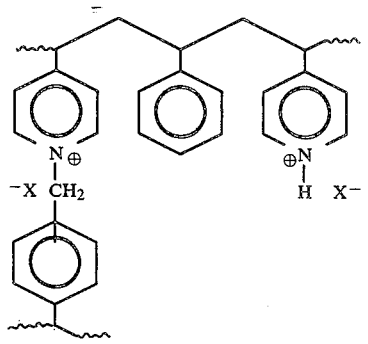

N: X > 1

By incorporation of a sufficient quantity of styrene in the VP-S copolymer, the number of immediately adjacent fixed cations is reduced to such an extent that the resulting fixed cation repulsion is not sufficient to become macroscopically discernible as fragility. Through the incorporation of a sufficient quantity of styrene in the copolymer, it is possible by the process according to the invention to produce permselective and flexible exchanger membranes with N:X=1 or N:X>1. The case where N:X=1 is particularly important when it is desired to obtain an exchanger membrane showing maximal permselectivity for anions (hereinafter referred to as "permselectivity"). The case where N:X>1 is significant for applications where high flexibility is more important than reaching the maximum possible permselectivity.

According to the invention, a copolymer of vinylpyridine and a monomer is used for making the membrane. The copolymer may additionally contain polyvinylbenzyl halide or a second copolymer of vinylbenzyl halide and a monomer Y. According to the invention, therefore, the following three combinations are possible:

(1) (vinylpyridine-Y)-copolymer (2) (vinylpyridine-Y)-copolymer + polyvinylbenzyl halide (3) (vinylpyridine-Y)-copolymer + (vinylbenzyl-halide-Y)-copolymer According to the invention, 4-vinylpyridine and/or 2-vinylpyridine or derivatives thereof corresponding to formulae XIV and XV below are used.

(XIV)

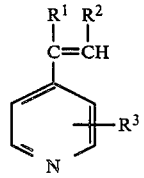

(XV)

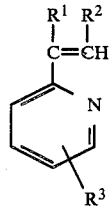

In formulae XIV and XV, $R^1$, $R^2$ and $R^3$ may be the same or different and each represent a hydrogen atom or a straight-chain or branched alkyl group containing from 1 to 4 carbon atoms. Compounds in which $R^1$ and $R^2$ represent hydrogen and $R^3$ represents hydrogen or an alkyl group are particularly preferred. Of these derivatives, the 4-vinyl substituted derivatives are particularly preferred. Particularly preferred compounds according to the invention are 4-vinylpyridine containing a methyl, ethyl, isopropyl or tert.-butyl group in the 2-position of the pyridine nucleus:

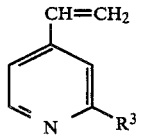

Mixtures of one or more of the above compounds may also be used.

The monomer Y in the copolymers must be a monomer which does not form fixed ions either during the crosslinking reaction or in the electrolyte. It may be aromatic or aliphatic. A mixture of one or more aromatic and/or aliphatic monomers may also be used. Examples of monomers are compounds corresponding to the following formula (III):

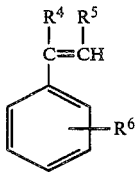

(III)

in which $R^4$, $R^5$ and $R^6$ may be the same or different and each represent a hydrogen atom or a straight-chain alkyl group containing from 1 to 8 carbon atoms or a branched alkyl group containing from 3 to 6 carbon atoms;

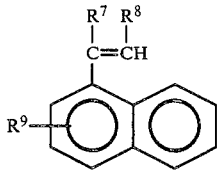

(IV)

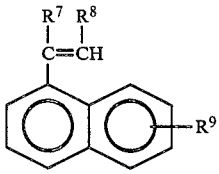

(V)

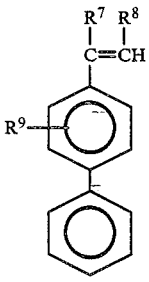

(VI)

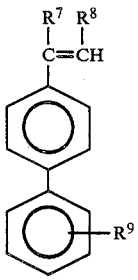

(VII)

or

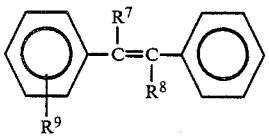

(VIII)

in which $R^7$, $R^8$ and $R^9$ may be the same or different and each represent a hydrogen atom, a straight-chain alkyl group containing from 1 to 8 carbon atoms or a branched alkyl group containing from 3 to 6 carbon atoms; or

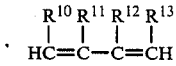

(IX)

in which $R^{10}$, $R^{11}$, $R^{12}$ and $R^{13}$ may be the same or different and each represent a hydrogen atom or a straight-chain alkyl group containing from 1 to 8 carbon atoms or a branched alkyl group containing from 3 to 6 carbon atoms; and $$CH_2=CH-(CH_2)_q-CH_3 \quad (X)$$

in which q=0 to 10, preferably 0 to 4 and more preferably 0, 1 or 2.

Examples of straight-chain alkyl groups in the above formulae are methyl, ethyl, n-propyl, n-butyl and n-pentyl groups. Of these groups, the methyl, ethyl and n-propyl groups are particularly preferred. Examples of branched alkyl groups containing from 3 to 6 carbon atoms are isopropyl, isobutyl and tert.-butyl groups, of which the isopropyl group and the isobutyl group are particularly preferred.

Of the compounds mentioned above, those in which the substituents $R^4$ and $R^5$, $R^7$ and $R^8$ each represent a hydrogen atom or a methyl group and the ring substituents $R^6$ or $R^9$ each represent a hydrogen atom or a methyl group are particularly preferred. According to the invention, styrene and its ring-substituted derivatives methylstyrene, ethylstyrene, isopropylstyrene, isobutylstyrene, tert.-butylstyrene, in the m-position or p-position, are particularly preferred.

Examples of aliphatic monomers are butadiene, propene, butene and pentene.

Particularly preferred copolymers of vinylpyridine are (4-vinylpyridine-styrene)-copolymers, (2-vinylpyridinestyrene)-copolymers, (4-vinylpyridine-butadiene)-copolymers, (2-vinylpyridine-butadiene)-copolymers, (4-vinylpyridine-propene)-copolymers, (2-vinylpyridine-propene)-copolymers, (4-vinylpyridine-vinylbiphenyl)-copolymers and (2-vinylpyridine-vinylbiphenyl)-copolymers.

The production of the copolymers is carried out by methods known per se and will not be discussed in any detail here. For example, they may be produced by radical or ionic polymerization; the polymerization may be carried out as emulsion or suspension polymerization or as mass polymerization. The combination of the properties of the membranes, namely that they are selective and flexible, is achieved by interrupting the direct sequence of vinylpyridine units in the polymer chain. Suitable interrupters are any monomers which have a sufficient size and which may readily be polymerized together with vinylpyridine.

According to the invention, polyvinylbenzyl halide or a copolymer of vinylbenzyl halide and a monomer Y is used as a further constituent of the membrane. The vinylbenzyl halide from which the polyvinylbenzyl halide is also produced in known manner corresponds to the following formula

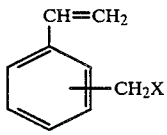

(XVI)

in which X is chlorine, bromine or iodine, preferably chlorine, and the group $CH_2X$ may be in the ortho, meta or para position. According to the invention, it is particularly preferred to use m- and p-vinylbenzyl chloride.

The monomer Y in the copolymer of XVI+Y may be the same as or different from the monomer present in the copolymer of vinylpyridine. Particularly preferred copolymers of vinylbenzyl halide and the monomer are those in which the substituents in the above formulae have the meanings defined above in connection with the copolymer of vinylpyridine. Particularly preferred copolymers are XVI+styrene, XVI+butadiene and XVI+propene.

In the above copolymers, the ratio of vinylpyridine-nitrogen:comonomer is expressed as N:X. The copolymers prepared or rather used in accordance with the invention are those in which N:X is in the range of from 1:1 to 50:1, preferably in the range of from 1:1 to 20:1 and more preferably in the range of from 1:1 to 10:1.

Where a mixture of (vinylpyridine-Y)-copolymer and polyvinylbenzyl halide is used, the copolymer and the polyvinylbenzyl halide are used in an N:X ratio of 10:1, preferably 5:1 and more preferably 1:1.

In the copolymer of vinylpyridine and/or vinylbenzyl halide and the monomer Y, the ratio of vinylpyridine and/or vinylbenzyl halide:Y is in the range of from 90:10 to 20:80, preferably in the range of from 70:30 to 30:70 and more preferably in the range of from 60:40 to 40:60.

In the mixture of (vinylpyridine-Y)-copolymer and (vinylbenzyl halide-Y)-copolymer, the N:X ratio is in the range of from 10:1 to 1:1.

To prepare the solution, the (vinylpyridine-Y)-copolymer is dissolved in methylene chloride or chloroform or dimethylformamide or in a mixture of two or three of these solvents. To prepare a solution which contains the (vinylpyridine-Y)-copolymer and the polyvinylbenzyl halide or the second copolymer, either the two constituents may be mixed and the solution subsequently prepared in the solvents mentioned or, alternatively, separate solutions may be prepared in the desired ratio and then correspondingly mixed.

The solvent and/or the solvent mixture must satisfy the requirement that it dissolve both polymers or copolymers. As mentioned above, N and X are stoichiometric ratios which may be exactly determined by test weighings. The adjustability of certain flexibility and selectivity values by variation of $N \geqq X$ is simple. For example, it is possible to prepare a mixture of (vinylpyridine-Y)-copolymer with polyvinylbenzyl halide or with the copolymer of vinylbenzyl halide and Y in a certain stoichiometric N:X-ratio of from 1:1 to 50:1. The membrane is prepared in known manner by application of the solution to an inert, non-porous carrier or to a porous carrier. It is preferred to use carrier materials which are completely inert to the solvents used, for example carriers of a Teflon film. Coating may be carried out by any of the usual processes, such as roll coating, knife coating, dip coating, spray coating, etc., the processes used optionally being applied repeatedly and/or in combination with one another. On completion of coating, it is important in accordance with the invention to ensure that the cross-linking reaction between the (vinylpyridine-Y)-copolymer and/or between this copolymer and the other constituents takes place. This is achieved by maintaining a solvent-moist state for a certain period. With low-boiling solvents or solvent mixtures, for example methylene chloride, chloroform or a mixture of these two solvents, the wet film prepared is stored in an atmosphere containing the solvent or solvent mixture for a period of from 5 minutes to several hours. Storage of the solvent-wet film may take place at a temperature of from room temperature to 100° C. It is preferred to work at room temperature. In the case of high-boiling solvents or solvent mixtures, such as dimethyl formamide or a mixture of dimethyl formamide with a halogenated hydrocarbon, such as methylene chloride or chloroform, the film prepared may simply be left standing in air.

The crosslinking reaction may be carried out over a period of from 5 minutes to 48 hours at temperatures of from 20° C. to 100° C.

By maintaining the solvent-moist state in the wet films, a quaternization reaction takes place spontaneously, even at room temperature, resulting in the formation of a crosslinked anion exchanger membrane. It is important to maintain the solvent-moist state until the described reaction has progressed to the maximum possible conversion.

On completion of the crosslinking reaction, the solvent is removed simply by drying, for example at a temperature in the range of from 20° C. to 70° C. and preferably at a temperature of from 20° C. to 30° C. The membrane may even be dried in vacuo.

To achieve the maximum possible permselectivity, the dried membrane may be post-crosslinked for 10 mins. to 2 hours at a temperature in the range of from 100° to 180° C. and preferably at a temperature in the range of from 100° to 160° C.

To produce a carrier-free membrane, the membrane is removed from the support. For applications where minimal electrical resistance of the membrane is more important than maximum mechanical stability, carrier-free membranes are preferred to carrier-supported membranes. Where maximum mechanical stability is the most important requirement for the application in question, carrier-supported membranes are superior to carrier-free membranes. According to the invention, it is possible to produce both types of membranes.

The membrane according to the invention is an anion exchanger membrane which may be used in any fields where such membranes are used, for example in electrochemical processes, electrochemical energy storage, electrolysis, electrodialysis, gas separation and pervaporation.

The invention is illustrated by the following Examples.

EXAMPLE 1

Absolute 4-vinyl pyridine (VP) and absolute styrene (S) are introduced in a molar ratio of 60 (VP):40 (S) into an ampoule with a ground-in cock. Approximately 1°/oo by weight ABN (azo-bis-isobutyronitrile) is added to the homogeneous mixture. Thereafter, the oxygen is removed at room temperature by repeated evacuation and venting with $N_2$. The ampoule is then sealed and copolymerization is carried out at 50° C.

On completion of the reaction, the copolymer is dissolved in THF and precipitated with petroleum ether. Dissolution and precipitation are repeated until the copolymer is white and no longer smells of monomer. The deposit is dried in vacuo.

Solutions of the VP-S copolymer and of poly(vinylbenzyl chloride) in methylene chloride are prepared in separate vessels. An N:X ratio of 1:1 is adjusted by appropriately selecting the concentrations of the two solutions and the ratios by volume of the two solutions during their mixing.

The homogeneous mixture is divided into two equal parts. One part is poured onto a Teflon support and distributed with a glass rod to prepare a carrier-free membrane. The second part is used to prepare a carrier-supported membrane. To this end, the second part of the homogeneous mixture is poured onto a glass fiber fleece and again distributed with a glass rod.

The carrier-free wet film and the carrier-supported wet film are stored in a vessel filled with a saturated $CH_2Cl_2$-atmosphere until the crosslinking reactiion is over (about 48 hours). The membranes are then dried in air. If maximal permselectivity is required, the membranes are post-crosslinked for up to 2 hours at 140° C. The carrier-free membrane is removed from the support.

EXAMPLE 2

A reaction mixture consisting of 34 parts by weight of monomer mixture, 2 parts by weight of sodium lauryl sulfate, $1\times10^{-3}$ parts by weight of potassium peroxodisulfate and 64 parts by weight of freshly boiled water is introduced into an ampoule with a ground-in cock filled with pure $N_2$.

The monomer mixture contains absolute vinyl pyridine (VP) and absolute butadiene (B) in a molar ratio of 1:1. The ampoule is closed and copolymerization carried out at 50° C. After a conversion of around 80%, copolymerization is stopped by addition of 0.1% by weight of hydroquinone. The copolymer latices suspension is poured into a glass beaker. Unreacted VP- and B-monomers are removed with steam. The latices are then precipitated with NaCl-solution and then with dilute $H_2SO_4$-solution. The $H_2SO_4$ added onto the VP is removed by stirring with NaOH. The latices are washed on a filter and dried.

The vinyl benzyl chloride-styrene copolymer (VBC-S) is prepared in the same way as described in Example 1 for the VP-S copolymer.

Solutions of VP-B and VBC-S copolymers are prepared in separate vessels. An N:X ratio of 1:1 is adjusted by appropriately selecting the concentrations of the two solutions and the ratios by volume of the two solutions during their mixing. The further procedure is as described in Example 1, a carrier-supported membrane and a carrier-free membrane being obtained.

I claim:

1. A process for preparing an anion exchange membrane which comprises: applying to a carrier material a solution comprising (1) a copolymer consisting of vinylpyridine and styrene and (2) a member selected from (a) polyvinylbenzyl halide and (b) a copolymer consisting of vinylbenzyl halide and styrene; subjecting said solution to cross linking and quaternization; removing solvent to form a dried membrane; and optionally removing said membrane from said carrier, the styrene content in each copolymer being 40–60% and the stochiometric ratio of said vinylpyridine/styrene copolymer to said member being 1-3:1 whereby both a high degree of permselectivity and a high degree of flexibility are imparted to said membrane.

2. A process according to claim 1 in which the member is polyvinylbenzyl halide.

3. An anion exchange membrane having simultaneously a high degree of permselectivity and a high degree of flexibility prepared according to the process of claim 1.

4. An anion exchange membrane having simultaneously a high degree of permselectivity and a high degree of flexibility prepared according to the process of claim 2.

5. A process according to claim 2 in which the ratio of vinylpyridine/styrene copolymer to polyvinylbenzyl halide is 2–3:1.

6. An anion exchange membrane having simultaneously a high degree of permselectivity and a high degree of flexibility prepared according to the process of claim 5.

* * * * *